US007497102B2

(12) United States Patent
Yu

(10) Patent No.: US 7,497,102 B2
(45) **Date of Patent: *Mar. 3, 2009**

(54) WOVEN STRAP LOCK STRUCTURE

(76) Inventor: Chun-Te Yu, No. 41-21, Kuan Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 433 days.

This patent is subject to a terminal disclaimer.

(21) Appl. No.: 10/792,875

(22) Filed: Mar. 5, 2004

(65) Prior Publication Data

US 2005/0155397 A1 Jul. 21, 2005

(30) Foreign Application Priority Data

Jan. 19, 2004 (TW) ..... 93201051 U

(51) Int. Cl.
*E05B 73/00* (2006.01)

(52) U.S. Cl. ..... 70/58; 70/69; 70/284; 70/285

(58) Field of Classification Search ..... 70/18, 70/21, 69, 284, 285, 58, DIG. 63, 308–312, 70/315–318

See application file for complete search history.

(56) References Cited

U.S. PATENT DOCUMENTS 5,123,153 A 6/1992 Krauss
5,237,842 A * 8/1993 Rasch et al. ..... 70/285
6,016,675 A 1/2000 Te
6,189,348 B1 * 2/2001 Huang ..... 70/18
6,550,296 B2 * 4/2003 Segawa ..... 70/208
6,883,354 B1 * 4/2005 Yu ..... 70/18
6,912,879 B1 * 7/2005 Yu ..... 70/58

(Continued)

FOREIGN PATENT DOCUMENTS

TW 32470 9/1980

(Continued)

*Primary Examiner*—Lloyd A Gall
(74) *Attorney, Agent, or Firm*—Rosenberg, Klein & Lee

(57) ABSTRACT

A woven strap lock structure including a male fastener and a female fastener. One end of the male fastener has an insertion tongue formed with a latch hook edge. The female fastener is composed of a seat body and a teeterboard type latch plate pivotally connected with the seat body. A key-unlocked unit is disposed in a non-insertion end of the seat body for controlling a push button. The other end of the seat body is formed with an insertion opening corresponding to the insertion tongue. The seat body is formed with an operation room communicating with the insertion opening, in which the latch plate is mounted. A numeral unlocking unit is disposed on the latch plate. One end of the latch plate is formed with an engaging edge corresponding to the latch hook edge of the insertion tongue for latching with the latch hook edge. The other end of the latch plate is a press end which can be pressed into the seat body to make the end of the latch plate with the engaging edge turned upward. The push button is disposed at the press end and controlled by the numeral unlocking unit. In a natural state, one end of the push button is resiliently engaged on a support section of the support member. When the numeral unlocking unit is unlocked or the key-unlocked unit is operated by a key, the support section releases the push button, permitting the latch plate to be pressed and unlatched.

9 Claims, 10 Drawing Sheets

U.S. PATENT DOCUMENTS

| | | | | |
|---|---|---|---|---|
| 7,032,415 | B2 * | 4/2006 | Young | 70/18 |
| 7,104,095 | B1 * | 9/2006 | Lin | 70/58 |
| 7,159,422 | B1 | 1/2007 | Misner et al. | |
| 7,174,756 | B2 | 2/2007 | Ling | |
| 7,201,026 | B2 * | 4/2007 | Yu | 70/21 |
| 7,357,008 | B2 * | 4/2008 | Yu | 70/58 |
| 7,360,283 | B2 * | 4/2008 | Yu | 24/171 |
| 7,377,138 | B2 * | 5/2008 | Yu | 70/58 |
| 2003/0164009 | A1 * | 9/2003 | Levi | 70/18 |
| 2004/0226324 | A1 | 11/2004 | Loughlin et al. | |
| 2004/0255624 | A1 | 12/2004 | Loughlin et al. | |
| 2005/0039500 | A1 | 2/2005 | Yu | |
| 2005/0055810 | A1 | 3/2005 | Loughlin et al. | |
| 2005/0092039 | A1 * | 5/2005 | Mak et al. | 70/58 |
| 2006/0081022 | A1 * | 4/2006 | Yu | 70/58 |
| 2006/0207301 | A1 * | 9/2006 | Yu | 70/58 |
| 2006/0207302 | A1 * | 9/2006 | Yu | 70/58 |
| 2006/0272368 | A1 * | 12/2006 | Yu | 70/58 |
| 2007/0084256 | A1 * | 4/2007 | Wu | 70/58 |
| 2007/0175247 | A1 * | 8/2007 | Yu | 70/58 |
| 2007/0266746 | A1 * | 11/2007 | Yu | 70/69 |
| 2008/0016921 | A1 * | 1/2008 | Yu | 70/18 |
| 2008/0028805 | A1 * | 2/2008 | Yu | 70/69 |
| 2008/0041126 | A1 * | 2/2008 | Yu | 70/58 |

FOREIGN PATENT DOCUMENTS

| | | |
|---|---|---|
| TW | 46563 | 9/1982 |
| TW | 369068 | 9/1999 |
| TW | 479720 | 3/2002 |
| TW | 498918 | 8/2002 |
| TW | 550329 | 9/2003 |

* cited by examiner

WOVEN STRAP LOCK STRUCTURE

BACKGROUND OF THE INVENTION

The present invention is related to an improved woven strap lock structure, and more particularly to a woven strap lock structure with double locking effect.

The conventional locking apparatuses include numeral system and key-driven system. The numeral system includes numeral wheel type and press key type. These locking apparatuses are widely applied to various fields. For example, Taiwanese Patent No. 369068, entitled "hanging lock structure" and Taiwanese Patent No. 498918, entitled "hanging lock structure (5)" disclose locks pertaining to key-driven system. Taiwanese Patent No. 32470, entitled "numeral lock of baggage case or suitcase" and Taiwanese Patent No. 46563, entitled "adjustable numeral lock of suitcase" disclose locks pertaining to numeral system.

Practically, after the baggage case or suitcase is locked and transferred to a destination, it often takes place that a user misses the key or forgets to bring the key or forgets the unlocking number and cannot open the baggage case or suitcase. Under such circumstance, it is necessary to ask a locksmith to unlock or even break the lock for opening the baggage case or suitcase.

In another condition, it is known that when checked by U.S. customs workers, in case it is found the customs workers that the contents of the baggage case or suitcase are suspicious, the customs workers are authorized by U.S. government to forcedly break off the lock of the baggage case or suitcase and open the same for checking the contents. The damaged lock will be a loss of a user and will lead to trouble and inconvenience to the user, especially during travel.

In order to improve the above situation, U.S. government and customs regulate that the lock manufacturers must provide a standard key for the customs for opening all the locks manufactured by the manufacturers. According to this regulation, there are several lock manufacturers all over the world who are allowed to manufacture such locks.

It is therefore tried by the applicant to provide a locking apparatus which meets the regulation of U.S. government and customs. In case a user forgets to bring the unlocking tool or forgets the unlocking number, the locking apparatus provides another unlocking measure for the user.

SUMMARY OF THE INVENTION

It is therefore a primary object of the present invention to provide an improved woven strap lock structure which has double locking effect.

According to the above object, the woven strap lock structure of the present invention includes a male fastener and a female fastener. One end of the male fastener has an insertion tongue formed with a latch hook edge. The female fastener is composed of a seat body and a teeterboard type latch plate pivotally connected with the seat body. A key-unlocked unit is disposed in a non-insertion end of the seat body for controlling a push button. The other end of the seat body is formed with an insertion opening corresponding to the insertion tongue. The seat body is formed with an operation room communicating with the insertion opening, in which the latch plate is mounted. A numeral unlocking unit is disposed on the latch plate. One end of the latch plate is formed with an engaging edge corresponding to the latch hook edge of the insertion tongue for latching with the latch hook edge. The other end of the latch plate is a press end which can be pressed into the seat body to make the end of the latch plate with the engaging edge turned upward. The push button is disposed at the press end and controlled by the numeral unlocking unit. In a natural state, one end of the push button is resiliently engaged on a support section of the support member. When the numeral unlocking unit is unlocked or the key-unlocked unit is operated by a key, the support section releases the push button, permitting the latch plate to be pressed and unlatched.

The present invention can be best understood through the following description and accompanying drawings wherein:

DETAILED DESCRIPTION OF THE PREFERRED EMBODIMENTS

Figure 1:
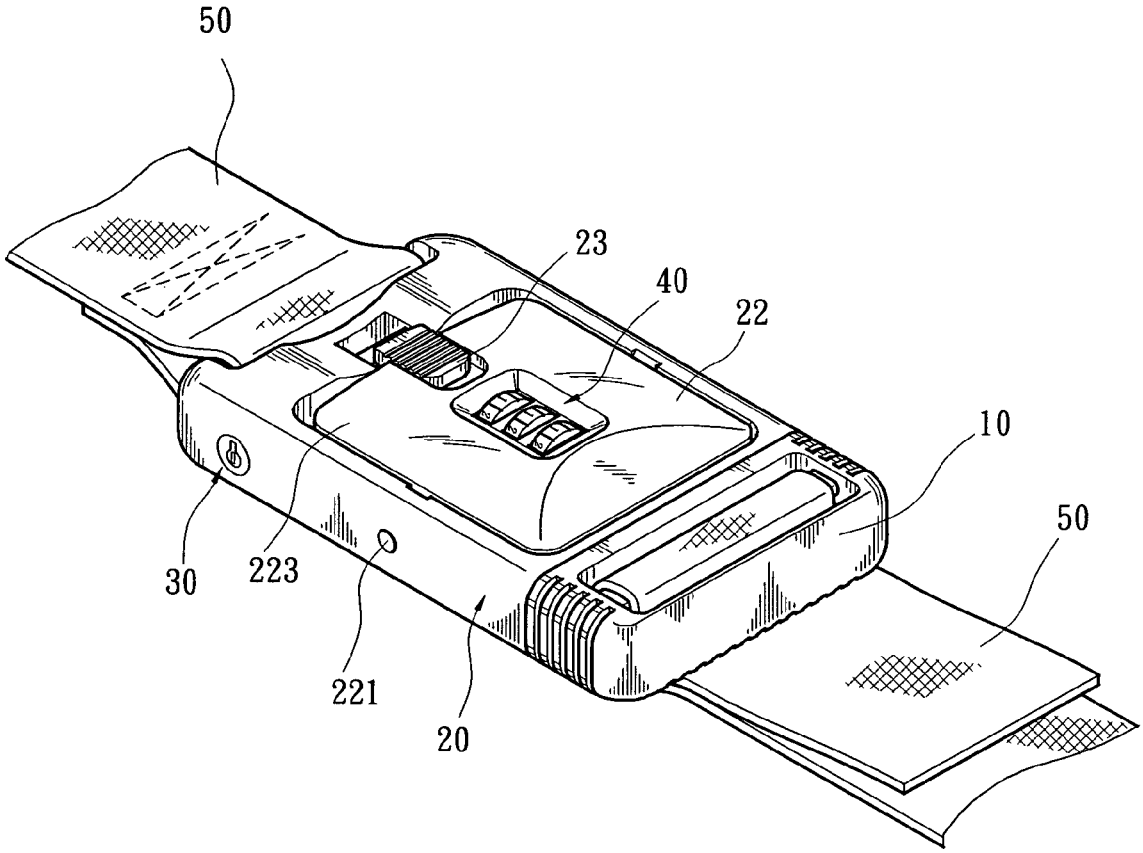
FIG. 1 is a perspective assembled view of a preferred embodiment of the present invention.
Figure 2:
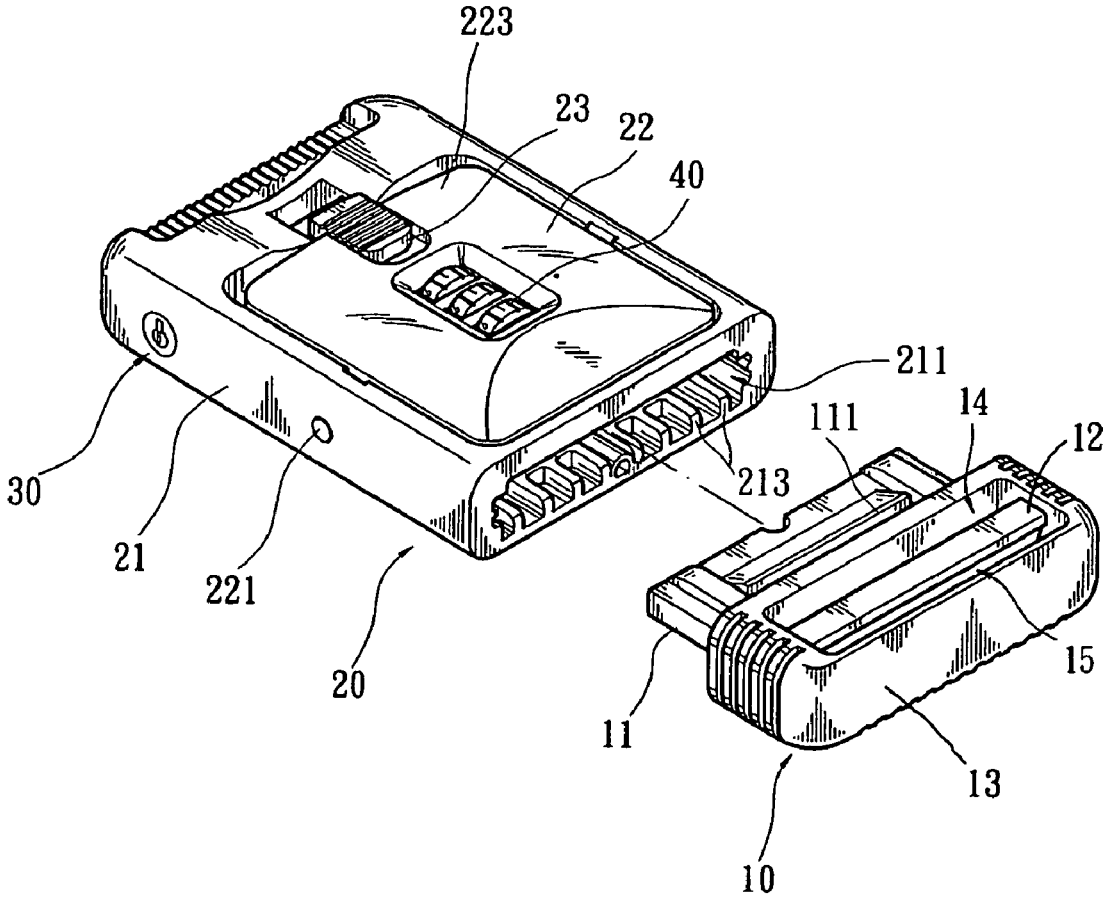
FIG. 2 is a perspective view of the present invention, showing that the male fastener is unlatched from the female fastener.
Figure 6:
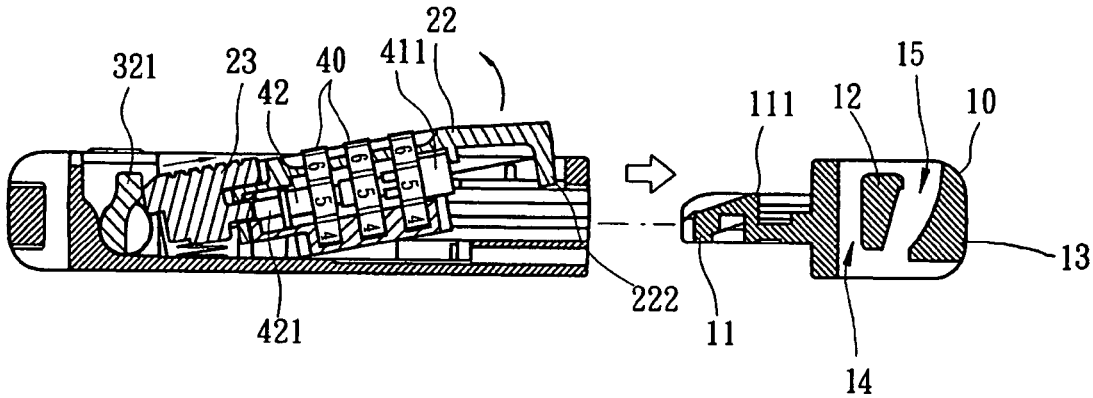
FIG. 6 is a sectional view showing that the numeral unlocking unit of the present invention is in an unlocked state with the male and female fasteners unlatched from each other.

Please refer to FIGS. 1 and 2. The woven strap lock structure of the present invention is composed of a male fastener 10 and a female fastener 20. One end of the male fastener 10 is looped by a fastening strap 50 and includes a first crossbar 12 and a second crossbar 13 juxtaposed to the first crossbar 12. The other end of the male fastener 10 has an insertion tongue 11 which can be inserted into the female fastener 20. As can be seen in FIGS. 2 and 6, the male fastener defines a first passage 14 and a second passage 15 therein. The first passage 14 is defined between the insertion tongue 11 and the first crossbar 12. The second passage 15 parallel to the first passage 14 is defined between the first crossbar 12 and the second crossbar 13 and is perpendicular to a direction along with the tongue 11 is inserted into the female fastener 20. A front end of the insertion tongue 11 is formed with a latch hook edge 111.

Figure 3:
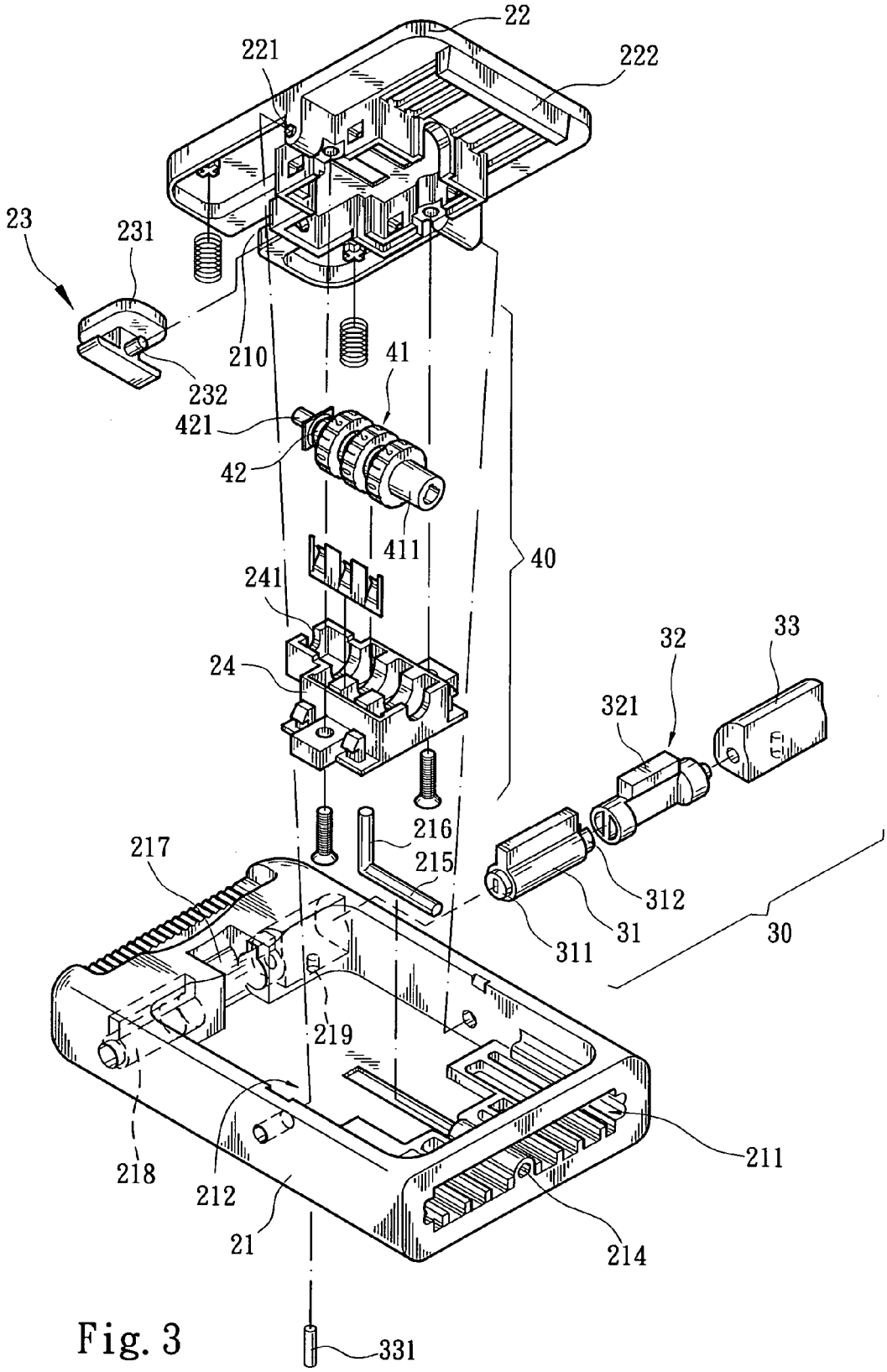
FIG. 3 is a perspective exploded view of the female fastener of the present invention.
Figure 4:
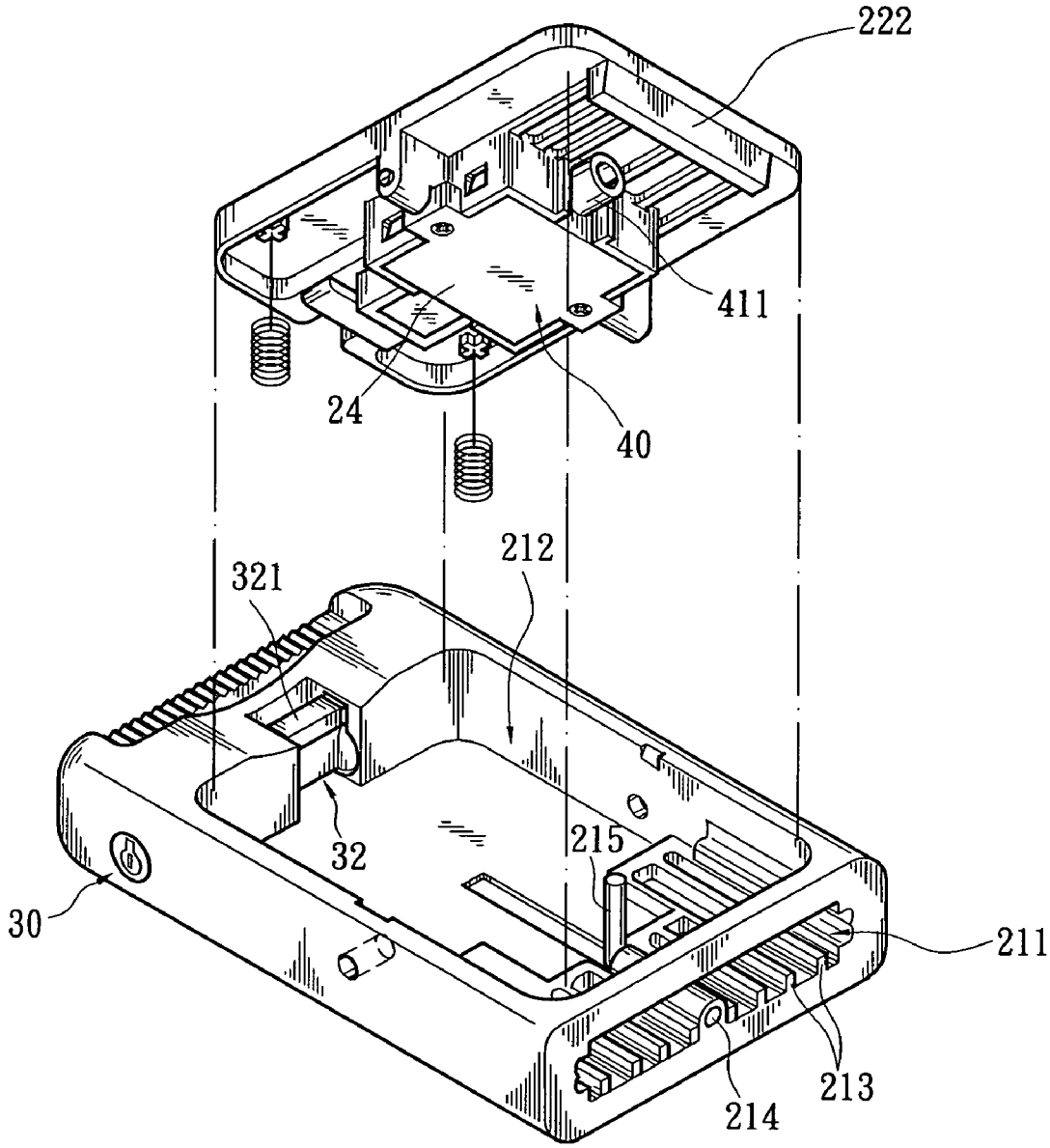
FIG. 4 is a perspective partially explode view of the female fastener according to FIG. 3.

Referring to FIGS. 2 to 4, the female fastener 20 is composed of a seat body 21 and a teeterboard type latch plate 22 pivotally connected with the seat body 21. A key-unlocked unit 30 is disposed in a non-insertion end of the seat body 21.

The other end of the seat body is formed with an insertion opening 211 corresponding to the insertion tongue 11 of the male fastener 10. In addition, the seat body 21 is recessed to form an operation room 212 communicating with the insertion opening 211. The latch plate 22 is mounted in the operation room 212. Stopper plates 213 are disposed in the operation room 212 near the insertion opening 211 without the entry of the insertion tongue 11. A number-changing rod receiving hole 214 is formed at the insertion opening 211 form outer side into the operation room 212. A number-changing push rod 215 is pivotally fitted in the receiving hole 214. An erect section 216 is formed at inner end of the push rod 215.

Two projecting shafts 221 are disposed on two sides of the latch plate 22 near a middle section thereof for pivotally connecting with two sides of the operation room 212 of the seat body 21. Accordingly, the latch plate 22 can be teetered back and forth within the operation room 212. A numeral unlocking unit 40 is disposed on inner face of the latch plate 22. One end of the latch plate 22 is formed with an engaging edge 222 corresponding to the inserted male fastener 10. When the insertion tongue 11 is inserted into the insertion opening 211, the engaging edge 222 is latched with the latch hook edge 111 of the insertion tongue 11. The other end of the latch plate is a press end 223 which can be pressed to lift the end with the engaging edge 222 so as to unlatch the latch hook edge 111. A movable member such as a push button 23 is disposed at the press end 223. The push button 23 is controlled by the numeral unlocking unit 40 to be displaceable or not.

The key-unlocked unit 30 is composed of a lock core seat 31, a support member 32 and a locating block 33. The lock core seat is fitted in a receptacle 218 of the seat body 21. An outer end of the lock core seat is formed with a key hole 311. An inner end of the lock core seat has a lock core 312 coupled with one end of the support member 32 for controlling the support member 32 to rotate. A support section 321 projects from the support member 32, whereby when the support member 32 is rotated, the support section 321 can enter a locking position to stop lower side of the push button 23 or enter an unlocking position to release the push button 23. The support member 32 is arranged in a dent 217 of the seat body 21. The other end of the support member is pivotally connected with the locating block 33. The locating block 33 is fixed in another receptacle 219 of the seat body 21 by a fixing member 331.

The numeral unlocking unit 40 is composed of a numeral wheel set 41 and a driving rod 42 driven and controlled by the numeral wheel set 41. The driving rod 42 is resiliently extensibly fitted in the numeral wheel set 41. A press end 421 of the driving rod 42 resiliently extends out from a hole 241 of the lock casing 24. The push button 23 of the latch plate 22 touches the press end 421 to control unlocking/locking thereof.

The press end 223 of the latch plate 22 is formed with a push slot 210 in which the push button 23 is slidably disposed. The push button 23 has a push plate 231. In natural state, a rear section of the push plate 231 can be resiliently pushed to engage on the support section 321 of the support member 32. The push button 23 has an abutting post 232 extending toward the lock casing 24. After assembled, the abutting post 232 right abuts against the press end 421 of the driving rod 42. In addition, after assembled, the erect section 216 of inner end of the number-changing push rod 215 right leans on a number-changing activating member 411 (such as numeral wheel bush of numeral lock) of the numeral unlocking unit 40.

Figure 5:
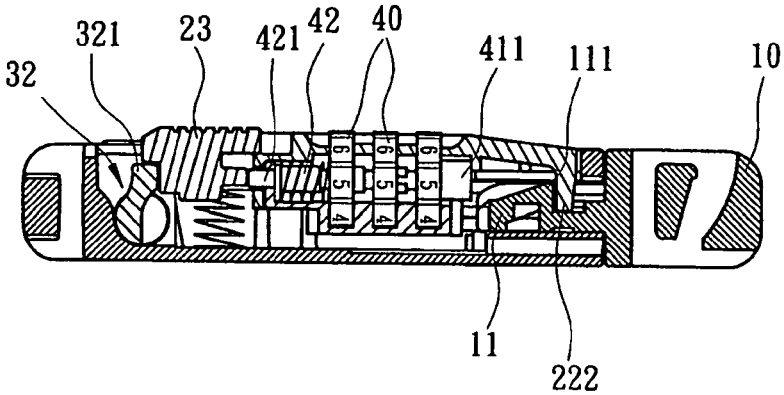
FIG. 5 is a sectional view showing that the numeral unlocking unit of the present invention is in a locked state with the male and female fasteners latched with each other.

Referring to FIGS. 5 and 6, when the numeral unlocking unit 40 is in an unlocked state, the latch plate 22 can push the push button 23 to disengage from the support section 321. At this time, the press end 223 can be pressed to make the other end with the engaging edge 222 turn upward and unlatch from the latch hook edge 111 of the insertion tongue 11. The push button 23 can be directly inward pushed by a finger to disengage the rear section of the push plate 231 from the support section 321. Then the press end 223 of the latch plate 22 is pressed down to unlatch from the latch hook edge 111.

Figure 7:
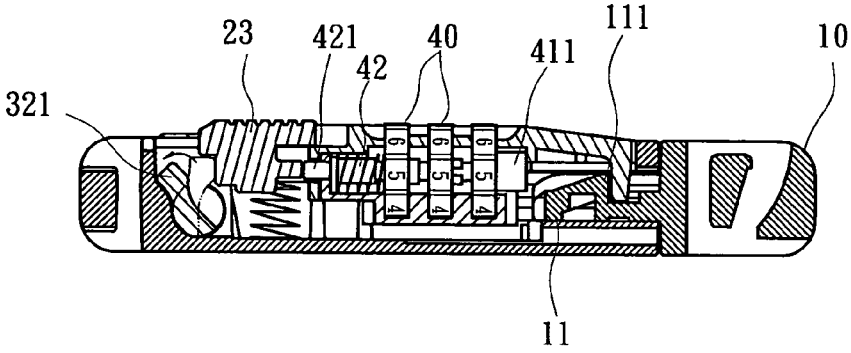
FIG. 7 is a sectional view showing that the key-unlocked unit of the present invention is in a locked state with the male and female fasteners latched with each other.
Figure 8:
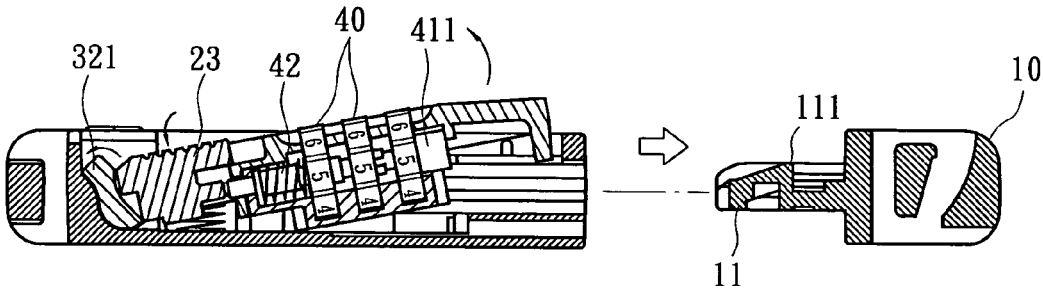
FIG. 8 is a sectional view showing that the key-unlocked unit of the present invention is in an unlocked state with the male and female fasteners unlatched from each other.

Referring to FIGS. 7 and 8, when a key is inserted into the key hole 311 of the key-unlocked unit 30 and turned to an unlocked state, the support section 321 of the support member 32 is turned outward and no more engaged with lower side of the push button 23. Therefore, there is a sufficient space for pressing down the press end 223 into the seat body 21. At this time, the other end with the engaging edge 222 is turned upward and unlatched from the latch hook edge 111 of the insertion tongue 11.

Figure 9:
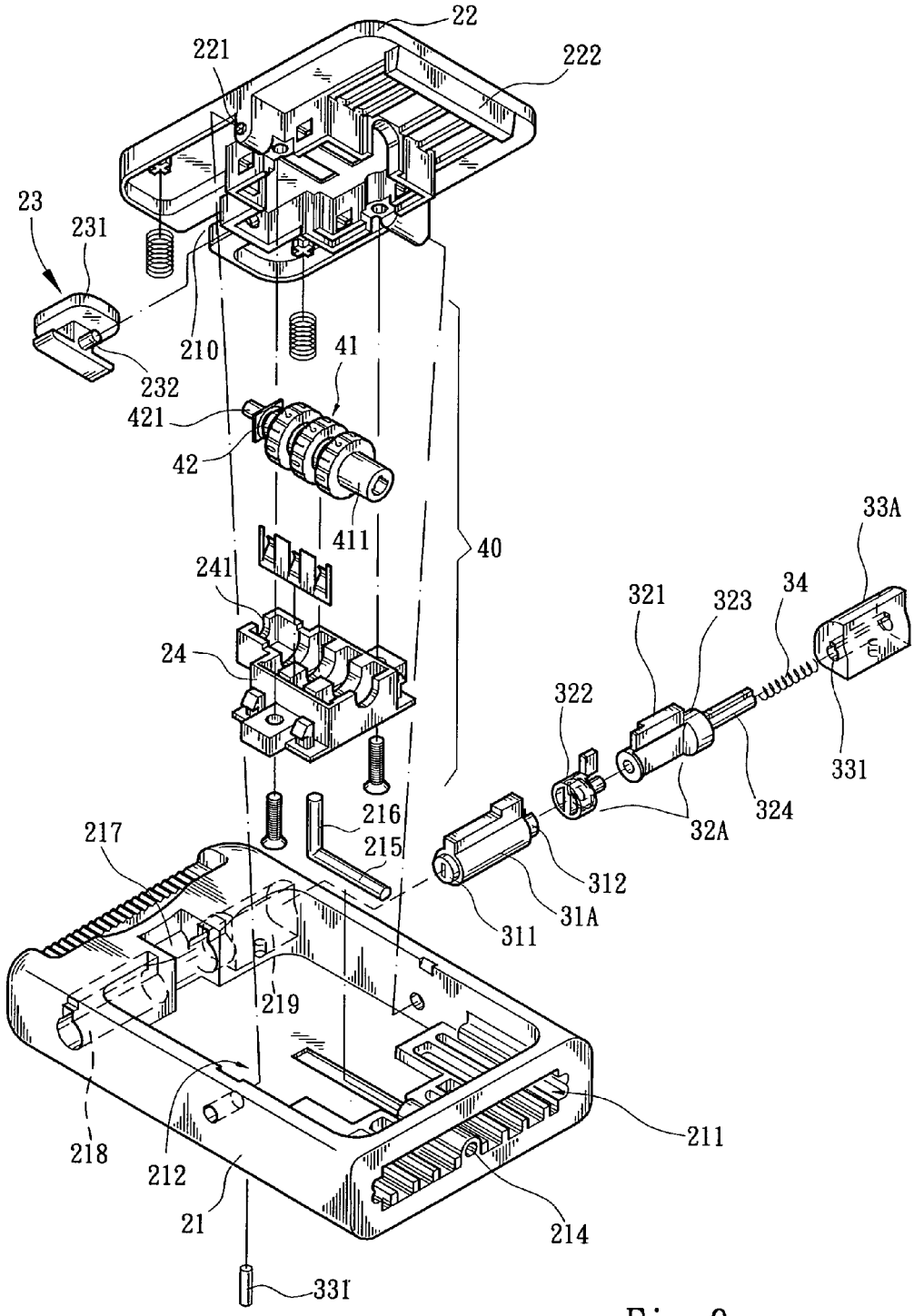
FIG. 9 is a perspective exploded view of another embodiment of the present invention, showing another type of key-unlocked unit.
Figure 10:
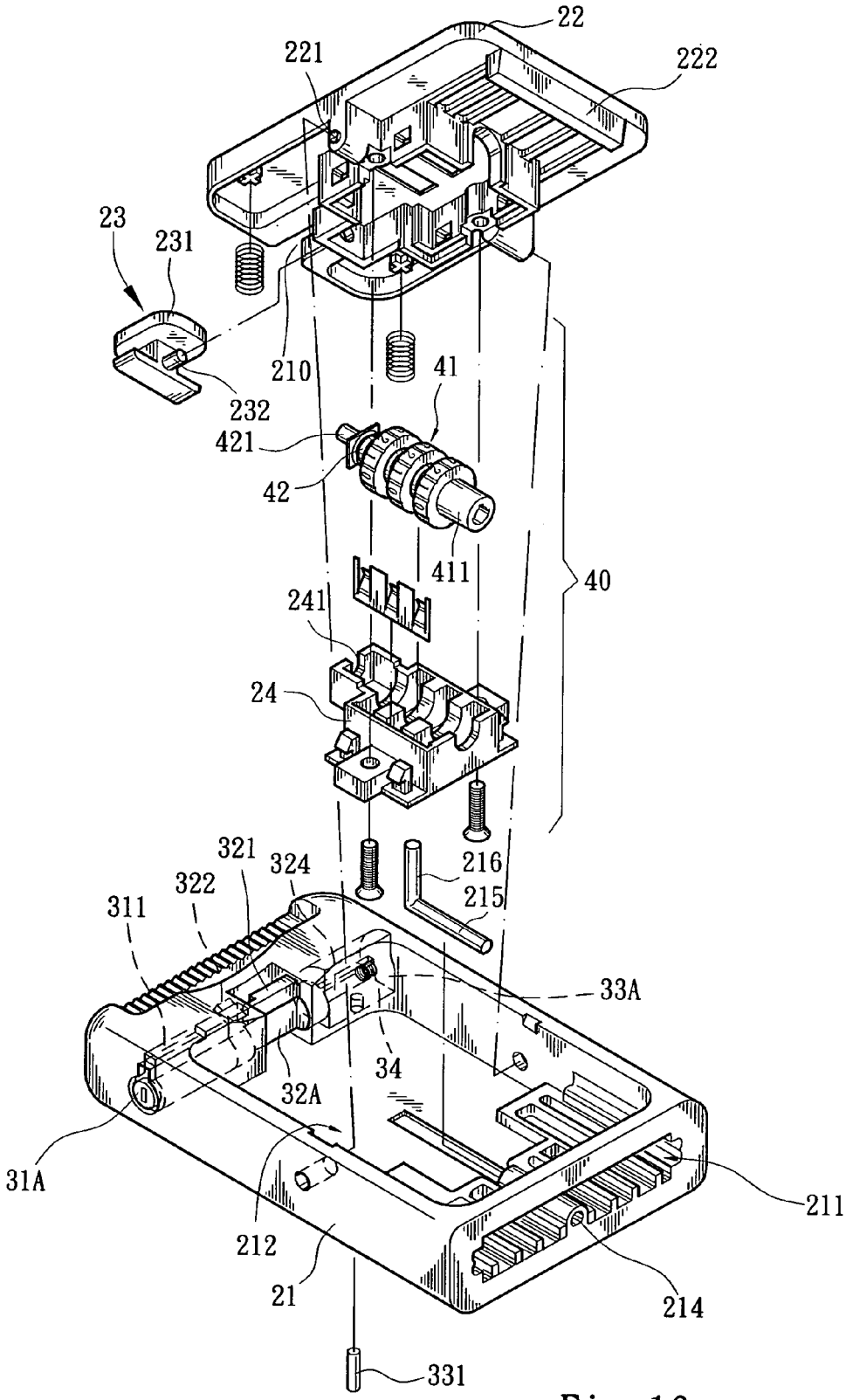
FIG. 10 is a perspective exploded view according to FIG. 9, in which the key-unlocked unit is in a locked state.
Figure 11:
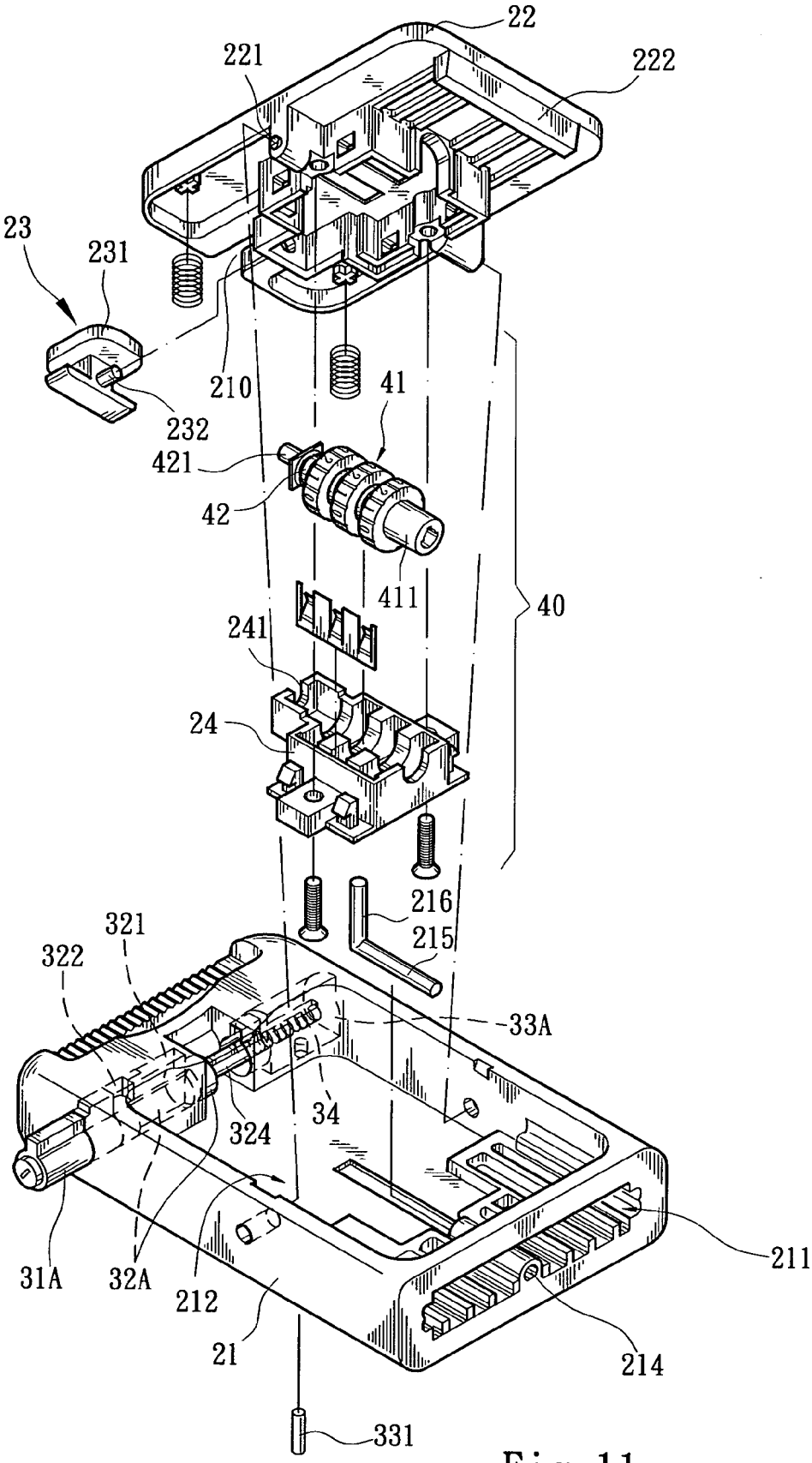
FIG. 11 is a perspective exploded view according to FIG. 9, in which the key-unlocked unit is in an unlocked state.

Referring to FIGS. 9 to 11, not only the key-unlocked unit 30 can be disengaged from the latch plate 22 by way of rotation, but also the lock core seat 31 can be axially drawn away from the engaged position. The key-unlocked unit can be alternatively composed of a lock core seat 31A, a support member 32A and a locating block 33A. The support member 32A is divided into a rotatable section 322 and a straight shift section 323 which is pivotally fitted with the rotatable section 322. One end of the straight shift section 323 is formed with a straight shift shaft 324 which is inserted in an extensible hole 331 of the locating block 33A. A resilient member 34 is disposed in the extensible hole 331 for resiliently pushing the straight shift shaft 324. In addition, the support member 32A has a support section 321 extending to the push button 23. One end of the rotatable section 322 is pivotally fitted in the straight shift section 321. The other end of the rotatable section 322 is coupled with inner end of the lock core 312 and rotatable therewith. The lock core seat 31A is mounted in the receptacle 218 of the seat body 21. The receptacle 218 is formed with a space allowing the lock core seat 31A to be axially outward drawn. Accordingly, in an unlocked state, the lock core seat 31A can be straightly shifted within the space. Reversely, in a locked state, the lock core seat is fixed in the space and cannot be straightly shifted. When the lock core seat is straightly shifted, the support member 32A can be straightly shifted to disengage from the push button 23.

Figure 12:
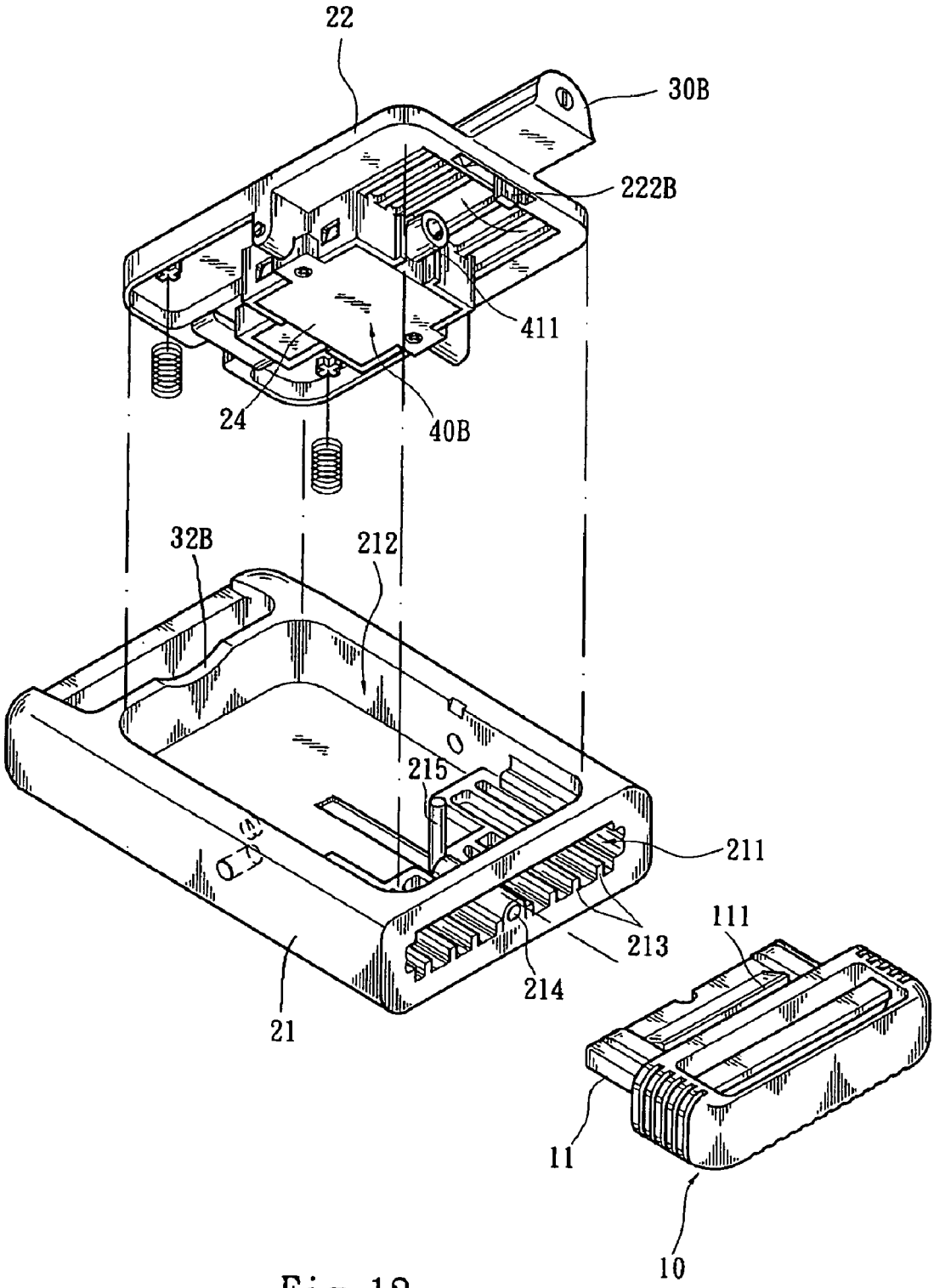
FIG. 12 is a perspective view showing that the key-unlocked unit of the present invention is mounted at one end of the latch plate with the engaging edge.

Referring to FIG. 12, the support member 32B is alternatively a fixed section of the seat body 21. The numeral unlocking unit 40B can control a movable member (such as a push button 23) to be movable or not. In a movable state, the latch plate 22 is free from the hindrance of the support member 32B and permitted to unlock and unlatch. The key-unlocked unit 30B can be mounted near the engaging edge 222B of the latch plate 22. The engaging edge 222B can be operated by the key-unlocked unit 30B to swing (as shown by the curved, double-ended arrow). Therefore, the latch hook edge 111 of the male fastener 10 can be released from the stop of the engaging edge 222B so that the male fastener 10 can be successfully extracted from the female fastener. This also achieves double unlocking effect.

According to the above arrangement, the present invention has double locking effects. In case a user forgets to bring an unlocking tool or forgets the unlocking number, the present invention provides another unlocking measure for the user. This also meets the regulation of U.S. customs. The present invention provides a convenient unlocking measure for a user, especially during travel.

The above embodiments are only used to illustrate the present invention, not intended to limit the scope thereof. Many modifications of the above embodiments can be made without departing from the spirit of the present invention.

What is claimed is:

1. A woven strap lock comprising:

a first snapping member;

a strap connected with the first snapping member;

a second snapping member connected with the strap and detachably connected to the first snapping member;

a key-unlocked unit disposed on the first snapping member and being capable of locking or unlocking the second snapping member via a key; and a numeral unlocking unit disposed on the first snapping member and being capable of locking or unlocking the second snapping member via a code.

2. The woven strap lock of claim 1, wherein the key-unlocked unit comprises a lock core operable by the key, and a support member which can be driven by the lock core to abut against or depart from the numeral unlocking unit.

3. The woven strap lock of claim 2, wherein the numeral unlocking unit comprises a controlling member that can be driven to abut against or depart from the key-unlocked unit when the code of the numeral unlocking unit is entered.

4. The woven strap lock of claim 1, wherein the first snapping member comprises:

a first seat body; and a second seat body movably mounted on the first seat body wherein movement of the second seat body is controlled by either one of the key-unlocked unit and the numeral unlocking unit.

5. The woven strap lock of claim 4, wherein the key-unlocked unit is disposed on the first seat body and the numeral unlocking unit is disposed on the second seat body.

6. The woven strap lock of claim 5, wherein the key-unlocked unit comprises a lock core operable by the key, and a support member driven by the lock core to abut against or depart from the numeral unlocking unit.

7. The woven strap lock of claim 6, wherein the numeral unlocking unit comprises a controlling member which can be driven to abut against or depart from the key-unlocked unit when the code of the numeral unlocking unit is entered.

8. A lock comprising:

a first seat body;

a snapping member detachably connected with the first seat body;

a second seat body movably mounted on the first seat body;

a numeral unlocking unit disposed on the second seat body and including a controlling member;

a key-unlocked unit disposed on the first seat body and including a support member and a lock core operable by a key;

wherein the support member of the key-unlocked unit is configured to be driven by the lock core to abut against or depart from the numeral unlocking unit; the controlling member of the numeral unlocking unit is configured to be driven to abut against or depart from the key-unlocked unit when a code of the numeral unlocking unit is entered; and thereby movement of the second seat body is controlled by either one of the key-unlocked unit and the numeral unlocking unit.

9. The lock of the claim 8 comprising a number-changing rod defined with a front section disposed in a hole of the first seat body, and a rear section connected to the numeral unlocking unit for changing a code of the numeral unlocking unit.

* * * * *